US006085744A

United States Patent [19]

Hermansen et al.

[11] Patent Number: 6,085,744

[45] Date of Patent: Jul. 11, 2000

[54] CLEANER AIR SNORKEL

[75] Inventors: Frank Hermansen; Carl Winefordner, both of Corona Del Mar, Calif.; Robert Wintner, Kingston, Wash.

[73] Assignee: Water Sports Distributing Inc., Seattle, Wash.

[21] Appl. No.: 09/188,191

[22] Filed: Nov. 9, 1998

[51] Int. Cl.[7] ..... B63C 11/16

[52] U.S. Cl. ..... 128/201.11; 128/201.27; 128/201.28

[58] Field of Search ..... 128/201.11, 201.27, 128/201.28, 200.29, 205.24, 206.29, 207.12

[56] References Cited

U.S. PATENT DOCUMENTS

| | | | |
|---|---|---|---|
| 4,655,212 | 4/1987 | Delphia | 128/201.11 |
| 5,117,817 | 6/1992 | Lin | 128/201.11 |
| 5,267,556 | 12/1993 | Feng | 128/201.11 |
| 5,280,785 | 1/1994 | Fujima | 128/201.11 |
| 5,404,872 | 4/1995 | Choi | 128/201.11 |
| 5,664,558 | 9/1997 | Wagner | 128/201.11 |

FOREIGN PATENT DOCUMENTS

| | | | |
|---|---|---|---|
| 2675112 | 10/1992 | France | 128/201.11 |
| 2246075 A | 1/1992 | United Kingdom | 128/201.11 |
| 91/109772 | 7/1991 | WIPO | 128/201.11 |
| 9117916 | 11/1991 | WIPO | 128/201.11 |

*Primary Examiner*—Aaron J. Lewis
*Assistant Examiner*—Teena Mitchell
*Attorney, Agent, or Firm*—Leonard Tachner

[57] ABSTRACT

A dual channel snorkel promotes cleaner air by substantially separating fresh air from used air. An upper valve comprises a pair of flexible material flaps which nominally permit flow only in opposite directions through the respective channels. However, when necessary for purging water, a strong exhalation will open both flaps upwardly to permit removal of water from both channels. The illustrated embodiment also comprises a lower valve and a splash guard.

9 Claims, 6 Drawing Sheets

CLEANER AIR SNORKEL

BACKGROUND OF THE INVENTION

1. Field of the Invention

The present invention relates generally to the art of snorkels. The invention relates more specifically to a snorkel that allows mostly "clean" air for inhalation.

2. Prior Art

Most snorkels have a single breathing tube for inhalation and exhalation. The problem with this is that at the end of each exhalation, the air that remains in the tube is the air that has been in the user's lungs the longest. This "used" air has less oxygen and more carbon dioxide than fresh air. With each inhalation, the user first inhales this "used" air and then begins to inhale fresh air once the internal volume of the snorkel has been evacuated. This causes an increased breathing rate and increases the chance of fatigue, dizziness and nausea.

The typical adult snorkel tube and elbow has an internal volume of 8 cubic inches. An adult man typically inhales between 60 and 120 cubic inches of air (1 to 2 liters) with each breath depending on their size and level of exertion. Typical women and children inhale a smaller volume. Therefore, the typical adult man inhales between 6.5% and 13% "used" air when using a regular snorkel. Women and children inhale an even larger percentage of "used" air.

The most obvious solution to solve this problem is to design a snorkel with two tubes that have two one-way valves such as the Wagner snorkel (U.S. Pat. No. 5,664,558). One of the problems with this design is that when the snorkel fills with water such as while descending a few feet, it is impossible to blow the water out of the inhalation tube. The next inhalation draws in water instead of air which can cause choking. Another problem with this design is that the breathing resistance for both inhalation and exhalation is high in a version of marketable size because typical one-way valves substantially reduce the flow area and require a high level of breathing exertion to fully open.

As mentioned in the Wagner patent, a clean air design in the prior art that is coaxial must have a larger outside volume compared to two tubes side by side for equivalent internal volumes for inhalation and exhalation. The Lin co-axial snorkel (U.S. Pat. No. 5,117,817) is both clean air and dry, but is also complex to make and cannot be made small enough to be marketable and have acceptable breathing resistance. As evidence, the Lin snorkel has been on the market for about 6 years, but without the center tube (has a single large tube) so that it does not have the clean air feature. It is only a dry snorkel.

It would be desirable to have a snorkel that reduces the amount of "used" air inhaled, but still has low breathing resistance, a relatively compact size, allows water to be purged out, and has relatively simple construction.

SUMMARY OF THE INVENTION

The snorkel herein is unique because it has an inhalation valve that does not completely shut so that when the user needs to purge out water, the inhalation valve can reverse and allow water to be expelled. While this means that the air inside the inhalation tube is less than 100% "clean", it is still substantially more clean than ordinary snorkels and without any of the other previously mentioned disadvantages. The valve design of the invention lowers the breathing resistance compared to standard one-way valves because it is hinged from only one side and because it is partially open in its relaxed state. The present invention comprises a substantially clean air snorkel which the benefits of a completely clean air snorkel and none of the disadvantages of such a snorkel. The preferred embodiment disclosed herein also has a lower valve to purge water trapped in the lower housing and a unique splash guard. Most significantly, the present invention is no larger, nor any more difficult to manufacture than conventional snorkels.

OBJECTS OF THE INVENTION

It is therefore a principal object of the present invention to provide a dual tube snorkel having less "bad" or "used" air than conventional snorkels but which nevertheless has the capability to expel water from the inhalation tube and has a low breathing resistance as compared to conventional co-axial tube clean air snorkels.

It is another object of the invention to provide a snorkel having substantially isolated twin air channels, one for inhalation and one for exhalation, each having a respective valve which promotes one-way air flow, but which still permits water purging through the inhalation channel.

It is still another object of the invention to provide a substantially improved snorkel having less "used" air than conventional snorkels and being substantially equal in size to conventional snorkels and being no more difficult to fabricate than conventional snorkels.

BRIEF DESCRIPTION OF THE DRAWINGS

The above-noted objects and advantages of the invention as well as additional objects and advantages thereof, will be more fully understood hereinafter as a result of a detailed description of a preferred embodiment when taken in conjunction with the accompanying drawings in which.

DETAILED DESCRIPTION OF A PREFERRED EMBODIMENT

Figure 1:
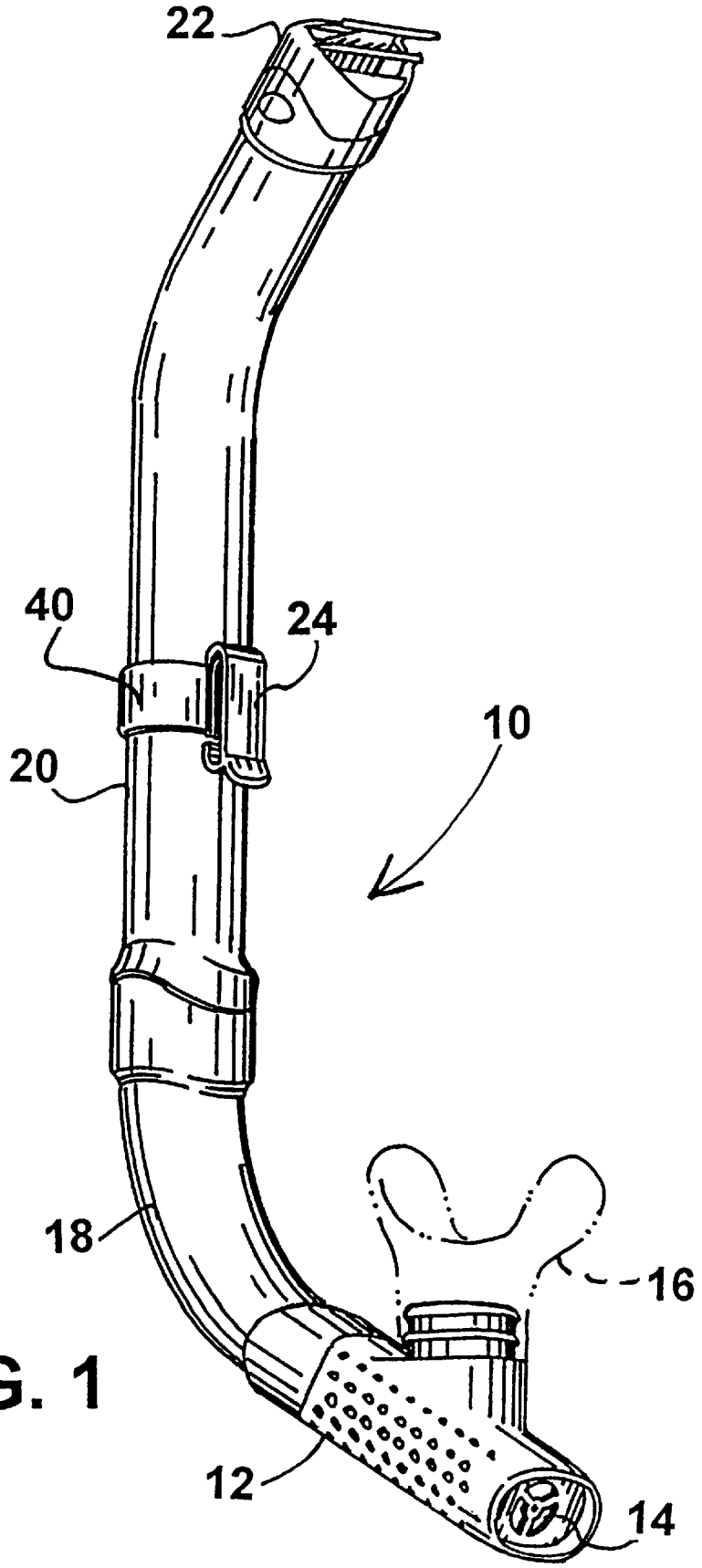
FIG. 1 is a three-dimensional view of the fully assembled snorkel of a preferred embodiment.

Referring to the accompanying figures and to FIG. 1 in particular, it will be seen that a cleaner air snorkel 10 in accordance with the present invention comprises a lower housing 12, an elbow 18, a tube 20 and a splash guard 22. The lower housing 12 has a lower valve 14 to permit water collected in the housing to escape. The housing is, of course, adapted to receive a mouthpiece 16 shown in FIG. 1 in phantom.

Figure 2:
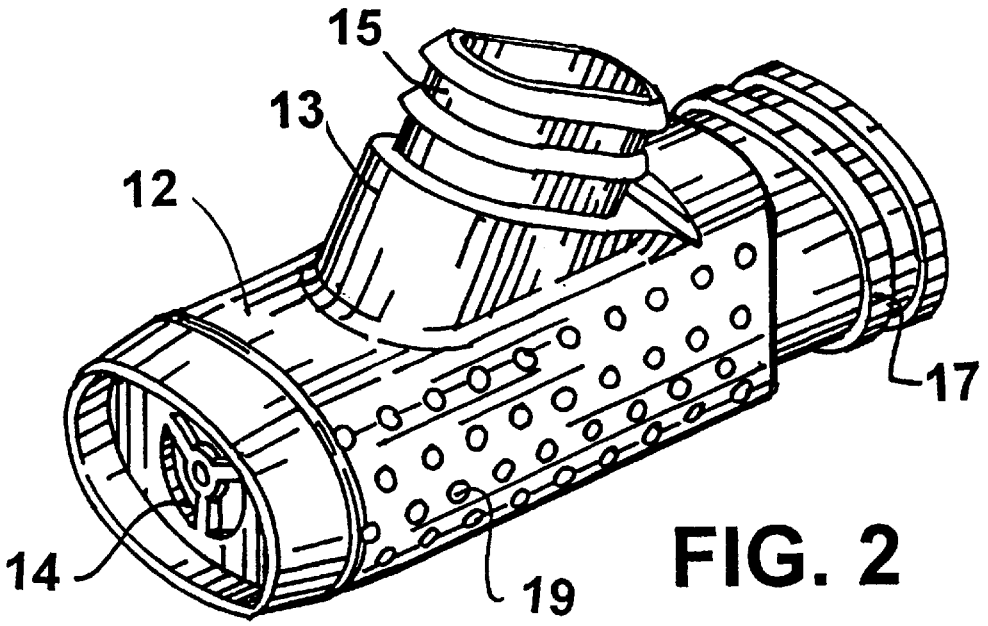
FIG. 2 is a three-dimensional view of the lower housing.
Figure 3:
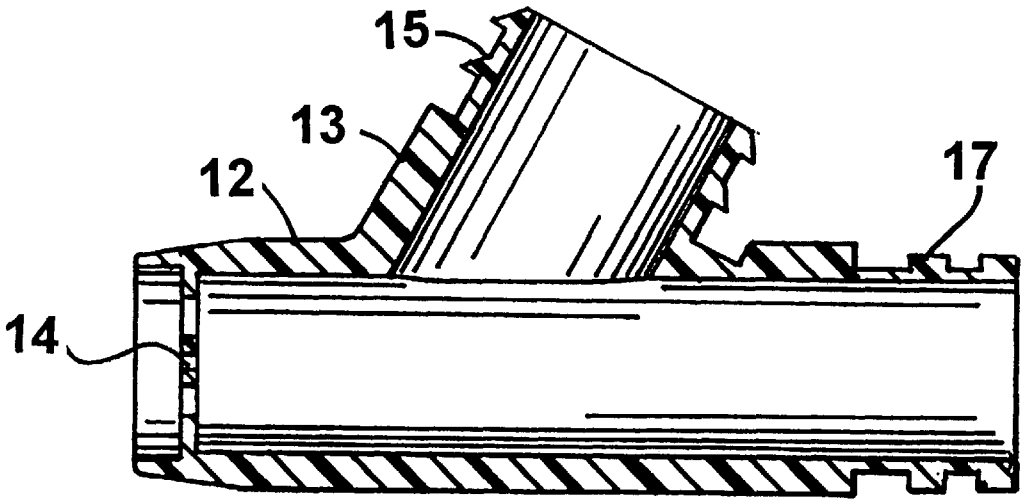
FIG. 3 is a cross-sectional view of the lower housing.
Figure 4:
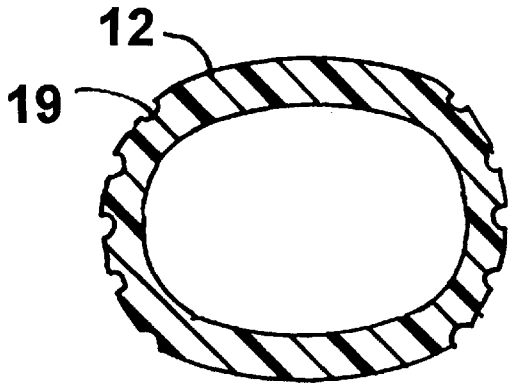
FIG. 4 is a cross-sectional view of the cylindrical wall of the lower housing.

As seen in FIGS. 2–4, lower housing 12 has a mouthpiece member 13 and a mouthpiece connector 15. Lower housing 12 also has an upper connector 17 designed to mate with elbow 18. A plurality of dimples 19 is provided along the sides of the lower housing to enhance gripping.

Figure 5:
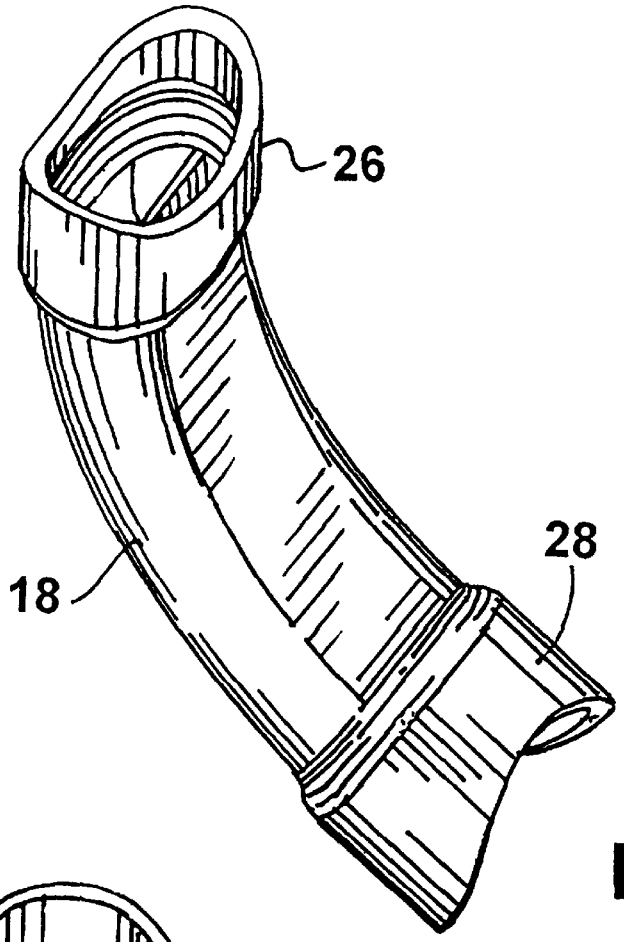
FIG. 5 is a three-dimensional view of the elbow of the preferred embodiment.
Figure 6:
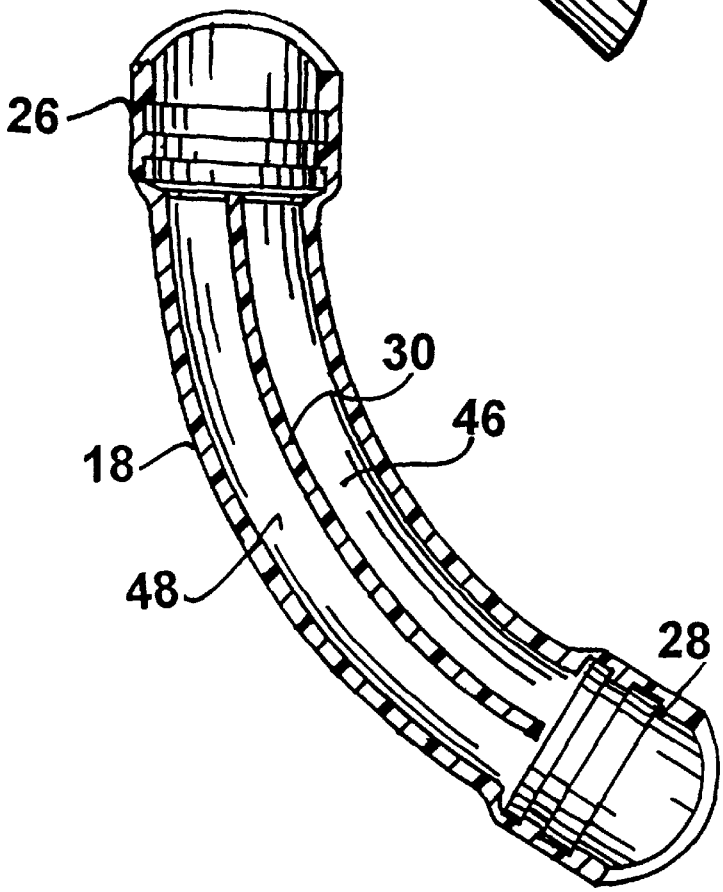
FIG. 6 is a cross-sectional view of the elbow.

As seen in FIGS. 5 and 6, elbow 18 has upper connector 26 and lower connector 28. Connector 26 is designed to mate with tube 20 and connector 28 is designed to receive upper connector 17 of lower housing 12. A divider 30 is provided within elbow 18 along a substantial portion of its length. Divider 30 forms two channels 46 and 48 which will be discussed hereinafter.

Figure 7:
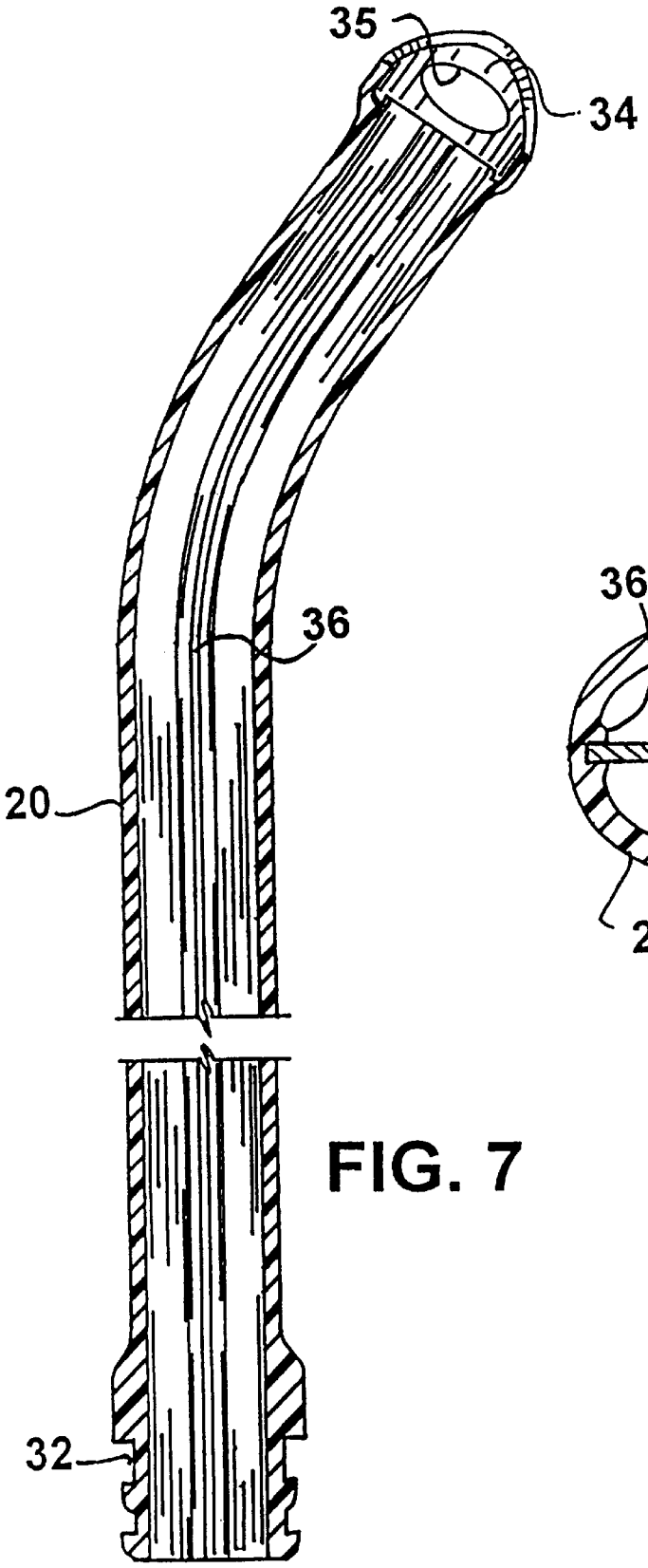
FIG. 7 is a cross-sectional view of the tube of the invention.
Figure 8:
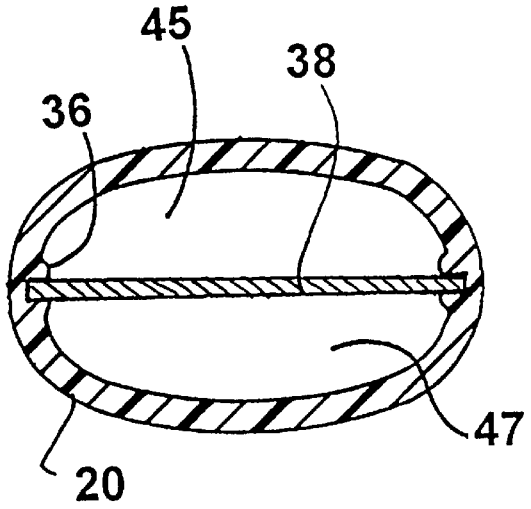
FIG. 8 is a cross-sectional view of the tube.

FIGS. 7 and 8 illustrate the detailed structure of the tube 20. Tube 20 is elongated and hollow and terminates in lower tube connector 32 (which mates with elbow 18) and in upper tube connector 34 (which mates with splash guard 22). At least one mating aperture 35 at connector 34, is designed to form a firm connection with the splash guard as described below. The tube 20 interior is provided with a pair of opposed, elongated, slotted receptacles 36. As seen best in FIG. 8, the receptacles 36 receive a tube divider 38 which extends the full length of tube 20 and divides the tube into two separate channels 45 and 47. The upper portion divider 30 of elbow 18 is designed to be aligned with divider 38 of tube 20 when the tube and elbow are mated. Thus channels 46 and 48 in the elbow are contiguous with channels 45 and 47 of the tube.

Figure 9:
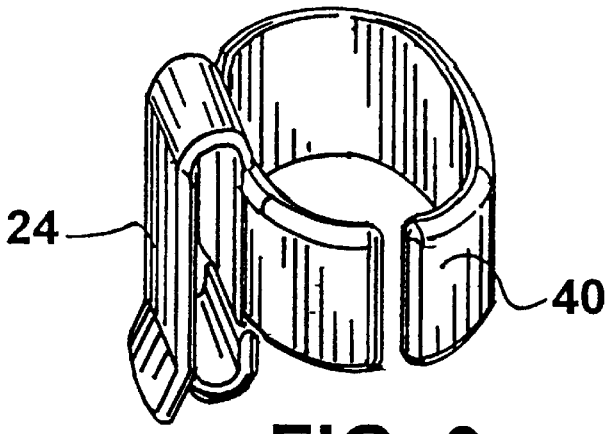
FIG. 9 is a three-dimensional view of the tube clamps and mask strap connector of the invention.
Figure 10:
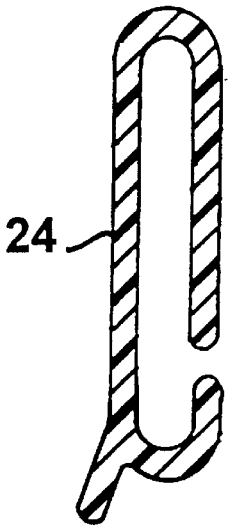
FIG. 10 is a cross-sectional view of the mask strap connector.
Figure 11:
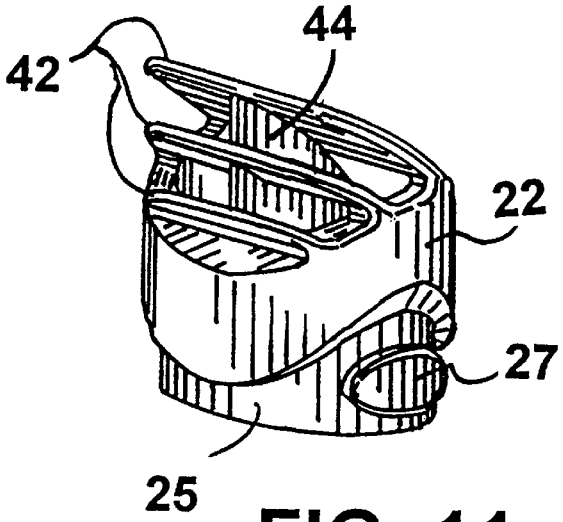
FIG. 11 is a three-dimensional view of the splash guard of the invention.
Figure 12:
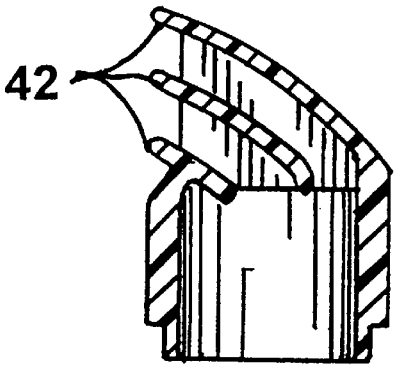
FIG. 12 is a cross-sectional view of the splash guard.

The snorkel of the present invention provides two optional features shown best in FIGS. 9–12. FIGS. 9–10 relate to a tube clamp 40 which substantially encircles tube 20 slidably engaging the tube at a selected location along its length. Clamp 40 is used to secure a mask strap connector 24 which is shaped to receive a mask strap (not shown) to secure the snorkel 10 to a mask (not shown). FIGS. 11 and 12 illustrate a splash guard 22 which is normally attached to the upper end of tube 20 at upper tube connector 34 (see FIG. 7). Splash guard 22 comprises a plurality of diagonal, spaced parallel strakes 42 supported by an underlying spline 44. The strakes' diagonal orientation permits inhalation and exhalation air flow to the side of the splash guard while preventing direct entry of water splash into the top of tube 20. Splash guard 22 is connected to tube 20 by means of connector 25 wherein mating projection 27 is secured within aperture 35 of connector 34 (see FIG. 7).

Figure 13:
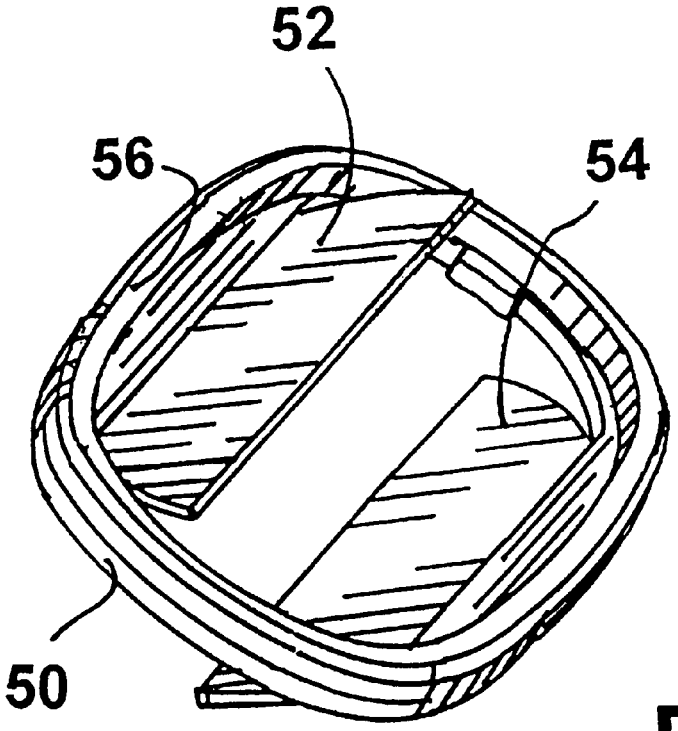
FIG. 13 is a three-dimensional view of the upper valve of the invention.
Figure 14:
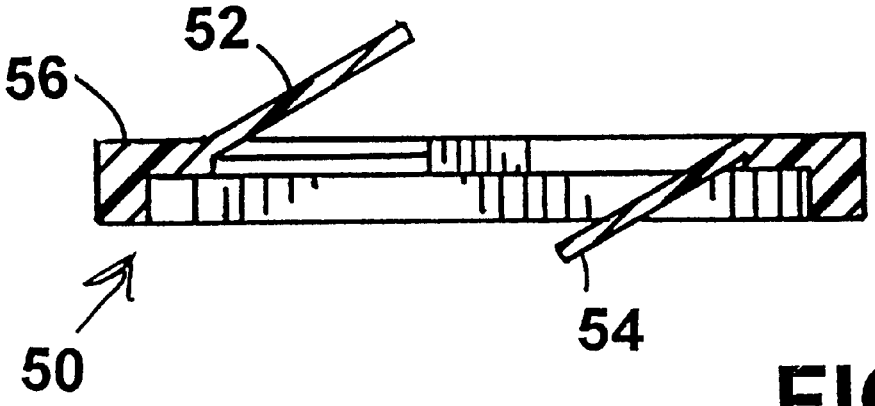
FIG. 14 is a cross-sectional view of the upper valve.

The "near clean" operation of the dual channel snorkel of the present invention is made possible by an upper valve 50 shown in FIGS. 13 and 14. Upper valve 50 is positioned at the upper end of tube 20 just below splash guard 22. Valve 50 comprises a pair of valve flaps 52 and 54. Valve flap 52 is positioned immediately adjacent channel 45 which is used as the exhalation channel. Valve flap 54 is positioned immediately adjacent channel 47 which is used as the inhalation channel. Flaps 52 and 54 are made of a relatively soft plastic planar material. The nominal position is shown in FIGS. 13 and 14. During inhalation, flap 52 flexes to a relatively sealed position while flap 54 flexes to a more open position. During exhalation, flap 52 flexes to a more open position while flap 54 flexes to a relatively sealed position. In this manner, the substantially clean air operation of snorkel 10 operates. However, whenever it becomes necessary to purge water from both channels 45 and 47, upper valve 50 permits such purging.

Having thus disclosed a preferred embodiment of the invention, it being understood that the invention is not limited by the disclosure but only by the appended claims, what we claim is:

1. A snorkel comprising:

a tube having two parallel, separated channels, one such channel being used for inhalation and the other such channel being used for exhalation, each such channel terminating in a valve flap, each such valve flap opening and closing over a nominal travel range for one-way air flow through a respective channel, the valve flap within the inhalation channel also opens beyond its nominal travel range responsive to sufficiently forceful exhalation through said tube for permitting purging of water through said inhalation channel.

2. The snorkel recited in claim 1 wherein said inhalation valve flap comprises a flexible material for partial bending during said purging of water.

3. The snorkel recited in claim 1, said tube having a substantially planar divider along substantially its entire length for forming said separated channels.

4. The snorkel recited in claim 1 further comprising a tubular elbow having two channels and being connected to said tube and a lower housing having a mouthpiece connector.

5. The snorkel recited in claim 1 further comprising a splash guard connected to said tube adjacent said valve flaps.

6. A snorkel comprising:

two parallel tubes having separate channels, one such channel being used for inhalation and the other such channel being used for exhalation, each such channel terminating in a valve flap, each such valve flap opening and closing over a nominal travel range for one-way air flow through a respective channel, the valve flap within the inhalation channel also opens beyond its nominal travel range responsive to a sufficiently forceful exhalation through said tube for permitting purging of water through said inhalation channel.

7. The snorkel recited in claim 6 wherein said inhalation valve flap comprises a flexible material for partial bending during said purging of water.

8. The snorkel recited in claim 6 further comprising a tubular elbow having two channels and being connected to said tubes and a lower housing having a mouthpiece connector.

9. The snorkel recited in claim 1 further comprising a splash guard connected to said tubes adjacent said valve flaps.

* * * * *